US008789718B1

(12) United States Patent
Daniel et al.

(10) Patent No.: US 8,789,718 B1
(45) Date of Patent: Jul. 29, 2014

(54) LID WITH A REMOVABLE PROTECTIVE COVER

(76) Inventors: Isaac S. Daniel, Miramar, FL (US); Peter Mastrorio, Boca Raton, FL (US)

( * ) Notice: Subject to any disclaimer, the term of this patent is extended or adjusted under 35 U.S.C. 154(b) by 134 days.

(21) Appl. No.: 13/094,357

(22) Filed: Apr. 26, 2011

Related U.S. Application Data

(60) Provisional application No. 61/328,066, filed on Apr. 26, 2010.

(51) Int. Cl.
*B65D 51/18* (2006.01)

(52) U.S. Cl.
USPC ..... 220/254.6; 220/257.1; 220/254.1; 220/832; 220/831; 215/235; 215/237; 229/906.1

(58) Field of Classification Search
CPC .... B65D 43/161; B65D 43/169; B65D 47/08; B65D 47/0847; B65D 47/0852; B65D 47/0874; B65D 2251/0021; B65D 2251/0071; B65D 2251/105; B65D 2251/108; B65D 2543/00379; B29C 65/3644; B29C 65/3656; B29C 65/368
USPC ..... 220/254.1–254.6, 257.1–257.2, 220/831–832, FOR. 203–FOR. 205, 207; 215/204; D9/447, 449; 222/480, 222/483–485, 498, 562; 229/906.1
See application file for complete search history.

(56) References Cited

U.S. PATENT DOCUMENTS

| | | | | |
|---|---|---|---|---|
| 3,421,654 | A * | 1/1969 | Hexel | 220/254.3 |
| 4,895,270 | A * | 1/1990 | Main et al. | 220/257.2 |
| 4,898,292 | A * | 2/1990 | VerWeyst et al. | 215/237 |
| 5,002,197 | A * | 3/1991 | Ponsi | 220/255 |
| 5,108,003 | A * | 4/1992 | Granofsky | 220/257.2 |
| 5,509,582 | A * | 4/1996 | Robbins, III | 222/480 |
| 5,579,932 | A * | 12/1996 | Drozd et al. | 215/207 |
| 5,636,732 | A * | 6/1997 | Gilels et al. | 206/37 |
| 5,697,509 | A * | 12/1997 | Hayes | 215/235 |
| 6,523,713 | B1 * | 2/2003 | Helms | 220/831 |
| 7,159,732 | B2 | 1/2007 | Smith et al. | |
| D537,717 | S | 3/2007 | Notarianni | |
| 7,246,715 | B2 | 7/2007 | Smith et al. | |
| 7,845,509 | B2 | 12/2010 | Burchard | |
| 7,975,868 | B1 * | 7/2011 | Flies et al. | 220/524 |
| 2002/0088802 | A1 * | 7/2002 | DeRose | 220/258.2 |
| 2003/0146217 | A1 * | 8/2003 | Takayama | 220/254.1 |
| 2005/0127075 | A1 | 6/2005 | Smith | |
| 2005/0247713 | A1 * | 11/2005 | Niederer et al. | 220/359.2 |
| 2006/0096983 | A1 | 5/2006 | Patterson | |
| 2006/0151512 | A1 * | 7/2006 | Van Heugten et al. | 220/826 |
| 2007/0131691 | A1 * | 6/2007 | Evans | 220/254.5 |
| 2008/0190951 | A1 * | 8/2008 | Gallagher et al. | 220/826 |
| 2009/0223981 | A1 * | 9/2009 | Levey | 220/712 |
| 2010/0122987 | A1 * | 5/2010 | Washington, II | 220/524 |

* cited by examiner

*Primary Examiner* — Mickey Yu
*Assistant Examiner* — Brijesh V. Patel
(74) *Attorney, Agent, or Firm* — Carol N. Green, Esq.

(57) ABSTRACT

The present disclosure relates generally to a lid comprising of: a brim latch adjoining a rim that extends around a periphery of the lid; a support tab in mating engagement with at least one wing that comprises of a top rim, an elevated member that extends upward and circumferentially from the brim latch, at least one sloped wall, and two side walls; and at least one film strip removably attached to the at least one wing, wherein the at least one film strip substantially covers the top rim of the at least one wing, which includes an arcuate portion sloping from side to side forming a u-shaped slope wherein the sides protrude upward and outward defining a lip contacting area causing a seal to be formed when the lip contacting area is engaged by an individual's lips.

24 Claims, 4 Drawing Sheets

LID WITH A REMOVABLE PROTECTIVE COVER

PRIORITY CLAIM

This patent application is a Continuation-in-Part patent application and claims priority, under 35 U.S.C. §119(e), to U.S. Provisional Patent Application Ser. No. 61/328,066, titled "A Lid With A Removable Protective Cover," filed Apr. 26, 2010 which is hereby incorporated by reference as if fully stated herein.

FIELD OF THE INVENTION

The present disclosure relates generally to a lid and more particularly, to a lid with a removable protective cover, i.e. a film strip.

BACKGROUND OF THE INVENTION

It is a known fact that germs may be transferred virally through human contact via the items we touch in our day to day personal exchanges. As such, it is wise to wash one's hands when handling food. Except, many food handlers do not always maintain the highest level of hygiene. In particular, fast food restaurants consistently handle large volume of diners with more emphasis on serving their customers than on hygienic practices. Thus, when a cashier receives money in exchange for the food purchased and then handles the food, e.g. a lid for sodas, coffee, tea and the like, in all likelihood, the cashier would not have washed his/her hand in between receiving the money and handling the lid causing the germs to be transmitted from one to another. Thus, there needs to be a more hygienic and sanitary approach to handling food and protecting items that come in direct contact with our mouths.

Selling coffee at fast food restaurants also pose other problems as the temperature of the coffee being served may be a lot hotter than what the customer expects. When covered, the purchaser has no idea as to the temperature of the coffee. Lids of the prior art include a return vent through which heat can escape. Except, the lids of the prior art are generally designed to fit the coffee cup and not necessarily to accommodate individual's lips, such that an individual has to be careful not to spill the hot coffee. Thus, there needs to a better solution for a more custom fitted lid that allows an individual to ventilate hot liquids to their liking that is ergonomically designed to fit a plurality of individual's lips forming a seal between their lips and the cover, thereby preventing spills.

Accordingly, the various embodiments and disclosures described herein satisfies these long felt needs and solves the limitations of the prior art in a new and novel manner.

SUMMARY

An objective of the invention is to provide an apparatus, i.e. a lid with a removable protective cover.

Another objective of the invention is to provide an improved lid configured to accommodate the lips of an individual.

Yet another objective of the invention is to provide an improved ergonomically fitted lid that allows a close fit between the individual's lips and the rim of the lid forming a seal such that the contents of the container are not spilled.

Yet another objective of the invention is to provide an apparatus that includes ventilation wings for the ventilation and cooling of hot liquids covered by the lid of the invention.

The present invention discloses a lid comprising of: a brim latch adjoining a rim that extends around a periphery of the lid; a support tab in mating engagement with at least one wing that comprises of a top rim, an elevated member that extends upward and circumferentially from the brim latch, at least one sloped wall, and two side walls; and at least one film strip removably attached to the at least one wing, wherein the at least one film strip substantially covers the top rim of the at least one wing, which includes an arcuate portion sloping from side to side forming a u-shaped slope wherein the sides protrude upward and outward defining a lip contacting area causing a seal to be formed when the lip contacting area is engaged by an individual's lips.

Accordingly, the various embodiments and disclosures described herein solve the limitations of the prior art in a new and novel manner.

DETAILED DESCRIPTION OF PREFERRED EMBODIMENTS

Figure 1:
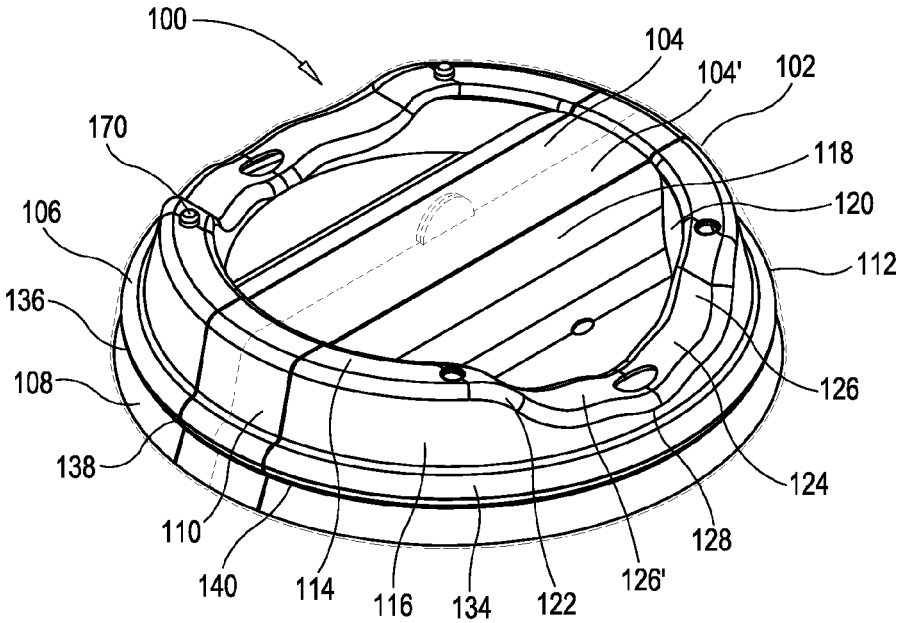
FIG. 1 is a perspective view of an apparatus, i.e. a lid with a removable protective cover.

The following discussion describes in detail an embodiment of the apparatus 100, i.e. a lid 102 with a film strip 104. However, this discussion should not be construed, as limiting the invention to those particular embodiments, as practitioners skilled in the art will appreciate that the apparatus 100 may vary as to configuration and as to details of the parts, without departing from the basic concepts as disclosed herein. Similarly, the elements described herein may be implemented separately, or in various combinations without departing from the teachings of the present invention. Turning now descriptively to the drawings, in which similar reference characters denote similar elements throughout the several views.

Figure 2:
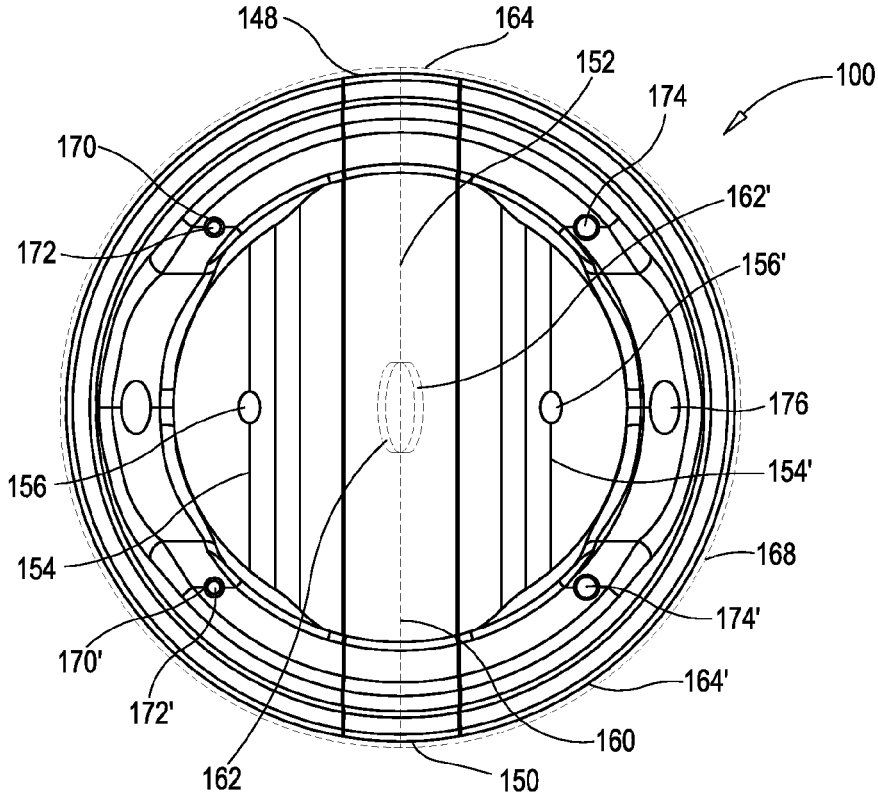
FIG. 2 is a top plan view of the lid with a removable protective cover.
Figure 3:
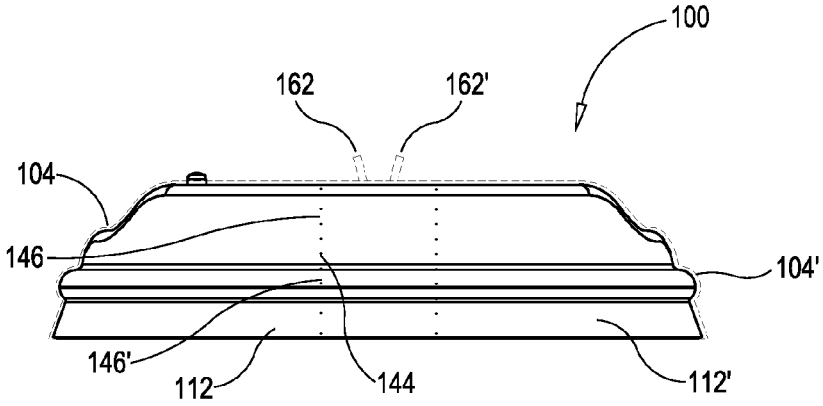
FIG. 3 is a side view of the lid with a removable protective cover.

FIGS. 1-3 are views of an apparatus 100, i.e. a lid 102 with a removable protective cover, i.e. a film strip 104, which is shown in broken lines but is a part of the invention. In some embodiments, the lid 102 comprises of: a brim latch 106 adjoining a rim 108 that extends around a periphery of the lid 102; a support tab 110 in mating engagement with at least one wing 112 that comprises of a top rim 114, an elevated member 116 that extends upward and circumferentially from the brim latch 106, at least one or more sloped wall 118, 118' and two side walls 120, 120'; and the at least one film strip 104 removably attached to the at least one wing 112, wherein the at least one film strip 104 substantially covers the top rim 114 of the at least one wing 112, which includes an arcuate portion 122 sloping from side to side forming a u-shaped slope 124 wherein the sides 126, 126' protrude upward and outward defining a lip contacting area 128 causing a seal to be formed when the lip contacting area 128 is engaged by an individual's lips.

The lid 102 is suited for disposable cups as are generally used in the fast food industry as well as non-disposable cups or containers that can accommodate a lid 102. The lid 102 and its component parts are preferably formed as one unitary piece, and are generally constructed from any one or more of the following materials: plastic, light aluminum, e.g. High Impact Polystrene (HIPS). The lid 102 may also be constructed from paper, cardboard or other like suitable materials. In the preferred embodiment, the lid 102 is preferably constructed from one material, while in some embodiments the wings 112, 112' and the support tab 110 maybe constructed from differing materials, e.g. plastic and/or paper.

Figure 4:
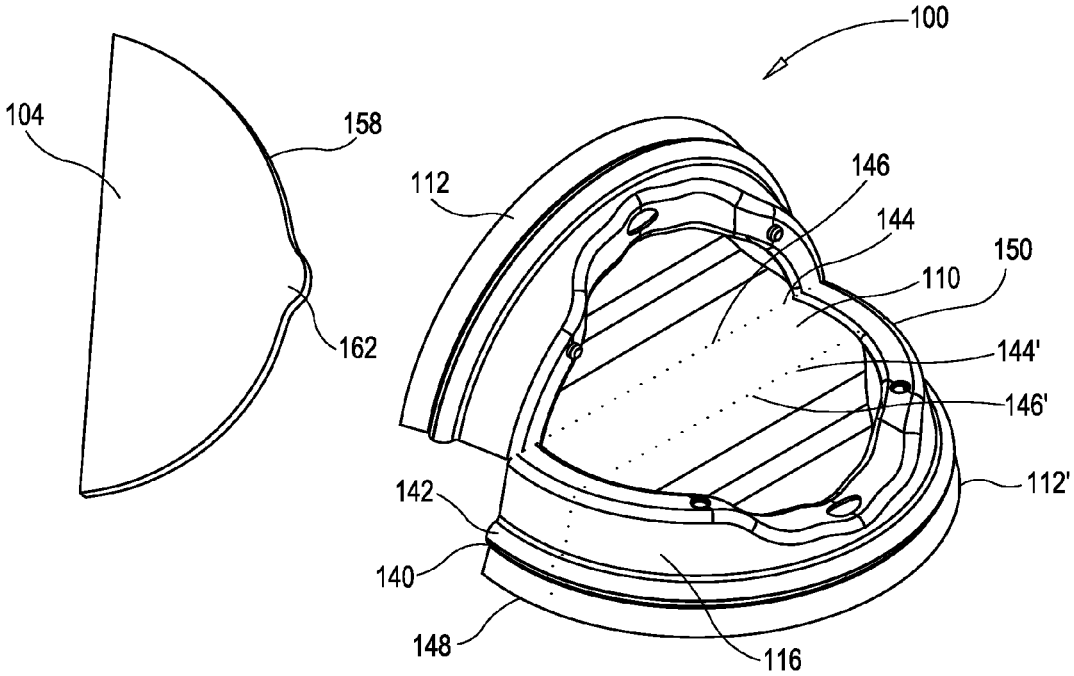
FIG. 4 is a perspective view of the lid with one wing in the open position with the film strip removed.

Lid 102 includes a brim latch 106 as is commonly known and used in the arts, which includes top 130 (not shown), inside surfaces 132, 132' (not shown) and outside surfaces 134, 134' respectively, as are well known and used in the arts. The brim latch 106 is adjoining to the rim 108 and extends around a periphery 136 of the lid 102, extending circumferentially along the lid's perimeter 138 and includes a clamping edge 140 as is well known and used in the arts with an open recess 142 (as shown in FIG. 4) adapted to be in mating engagement with the rim of a container such that clamping edge 140 sealingly engages the rim of the container trapping its contents within. The clamping edge 140 extends around the entire perimeter 138 of the lid 102 for clamping onto the container's rim so that the lid 102 can be reliably and sealingly affixed to the container's rim.

Figure 5:
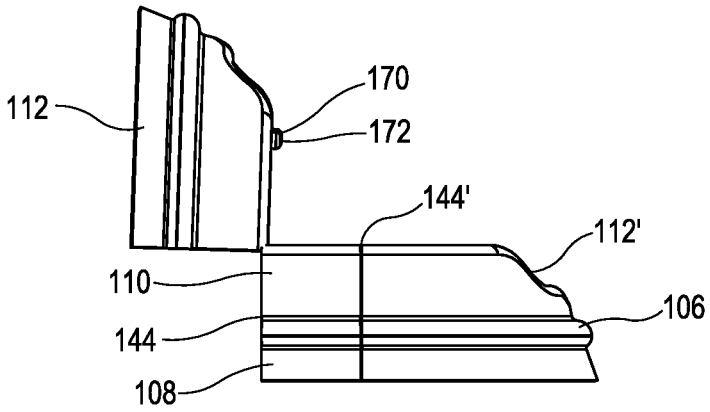
FIG. 5 is a side view with one wing of the lid in an open position with the film strip removed.

FIGS. 4 & 5 show the at least one wing 112 of the lid 102 in an open position with the film strip 104 removed. As shown, the lid 102 includes a support tab 110 in mating engagement with at least one wing 112 along a first horizontal edge 144 of the support tab 110. The at least one wing 112 is releasably attached along the support tab's first horizontal edge 144 by perforations 146, 146', 146" that extend from a distal end 148 to a proximal end 150 of the support tab's first horizontal edge 144. Perforations 146, 146' as used herein describes a plurality of holes spaced apart that are symmetrically aligned along the first and/or second horizontal edges 144, 144' providing for the releasable detachment of the wings 112, 112' in part, or wholly from the support tab 110 with ease, such that the wing 11 may be vertically lifted to provide ventilation.

The support tab 110 is diametrically disposed across the lid's midsection 152 from one edge of the rim 108 to the other 108' and is adapted to provide an anchor for the at least one wing 112 when the at least one wing 112 is in an open position. In this manner, an individual may open the at least one wing 112 to ventilate and/or cool the contents within the container being covered by the lid 102, but still retain a partial closure of the lid 102 preventing any unwanted items from falling within or the container's contents spilling therefrom. Additionally, the opened wing 112 allows an individual to expose a wider surface area for gripping a container's rim to access the contents within.

In some embodiments, lid 102 further comprises of a second wing 112' of equal size that is arranged diametrically opposite the at least one wing 112. The second wing 112' may also be in mating engagement with the support tab 110 and is releasably attached along the support tab's second horizontal edge 144' by perforations 146", 146''' that extend from a distal end 148' to a proximal end 150' of the support tab's second horizontal edge 144'. In this manner, an individual may detach the wings 112, 112' along the first and/or second horizontal edges 144, 144' to ventilate and/or cool the contents within the container leaving both wings 112, 112' in an open position for a faster cooling of the contents within.

In yet another embodiment, the second wing 112' may not include perforations 146, 146' along the second horizontal edge 144 such that the second wing 112 remains stationary on the container once the lid 112 is first engaged with the container's rim. In that embodiment, the second wing 112' may merge with the support tab along the second horizontal edge 144' forming one single unitary stationary wing 112/support tab 110 forming an anchor for the at least one wing 112 in an open position.

Referring back to FIG. 1, in some embodiments the at least one wing 112 comprises of a top rim 114, an elevated member 116 that extends upward and circumferentially from the brim latch 106, a sloped wall 118, and two side walls 142. The top rim 114 is the general area that an individual's lips would engage when the lid 102 is positioned on a container for consuming the contents within after the film strip 104 has been removed. The top rim 114 includes an arcuate portion 122 sloping from side to side forming a u-shaped slope 124 wherein the sides 126, 126' protrude upward and outward defining a lip contacting area 128 causing a seal to be formed when the lip contacting area 128 is engaged by an individual's lips. In some embodiments, the second wing's top rim 114' also includes an arcuate portion 122' sloping from side to side forming a u-shaped slope 124' wherein the sides 126", 126''' protrude upward and outward defining a lip contacting area 128' on the second wing 112' causing a seal to be formed when the lip contacting area 128' of the second wing 112' is engaged by an individual's lips.

The lip contacting areas 128, 128' are smooth, contoured areas, whereby the arcuate portions 124, 124' track the shape of human lips such that there is an ergonomic fit between the individual's lips and the lip contacting areas 128, 128' to sealingly engage the lid 102. By this configuration, the drinking experience using the apparatus 100 provides for more comfort as the curvature of the lip contacting areas 128, 128' tracks the shape of an individual's lips. Lip contacting areas 128, 128' are bounded at the sides 126, 126', 126", 126''' by the elevated members 116, 116' which extend upwards and circumferentially from the brim latch 106 to a height that approximates 4/10 of an inch to one inch in some embodiments, facilitating the individual being able to grip the lid 102 comfortably for accessing the contents within the container. The at least one or more sloped walls 118, 118', 118", 118''' and the side walls 120, 120', 120", 120''' provide additional structural support for the wings 112, 112' and additional gripping surfaces for the individual's lips.

In some embodiments, both the at least one wing 112 and the second wing 112' include at least one or more sloped walls 118, 118', 118", 118''' that are oriented with a downward slant at an acute angle relative to the support tab 110, forming at least one overflow well 154 between the support tab 110, the sloped walls 118, 118', 118", 118''' and the lip contacting areas 128, 128' that are bounded circumferentially by the elevated members 116, 116'. The overflow well 154 helps reduce burning or discomfort to the lips as a result of hot pooled liquid that collects within. The overflow well 154 permits the reflow of any liquid back into the container, which occurs periodically when the lid 102 is in use. As the volume of liquid increases the overflow well 154 collects the excess and channels the excess liquid through at least one or more return vents 156, 156'. The return vent 156 comprises of an annular aperture positioned on any one or more of the following: the at least one wing 112 or the second wing 112' causing the return flow of excess liquids into the container being covered by the lid 102.

Protecting the lip contacting area 128 from third party contact is at least one thin, film strip 104 removably attached to the at least one wing 112, wherein the at least one film strip 104 substantially covers the top rim 114 of the at least one wing 112, sealing the lip contacting areas 128, 128' from third party contact until the individual is ready to peel the film strip 104 away just prior to use. In some embodiments, the film strip 104 may be layered on its underside 158 with a mild adhesive or non-toxic food glue or other non-toxic adhesives that are well known and used in the food industry. The adhesive is used to detachably secure the at least one film strip 104 to the lid 102 such that the film strip 104 can be readily peeled away without compromising its effectiveness as a protective shield from germs. The film strip 104 may be constructed from plastic or other like materials and in one preferred embodiment is approximately 0.7 mm to 0.9 mm thick. Nonetheless, the film strip 104 may be scaled to a desired thickness as deemed necessary. In some embodiments, the film strip 104 is thermally applied to the lid 102 providing for the film strip 104 to cling tightly to the lid 102 without the use of adhesives or any additional structure. In some embodiments, the at least one film strip 104 partially covers at least one lip contacting area 128, while in other embodiments the at least one film strip 104 substantially and/or wholly covers at least one lip contacting area 128. As shown in FIG. 1, the film strip 104 originates from at or around the middle 160 of the support tab 110 whereby it allows for the peeling of the film strip 104 without disengaging or dislodging the support tab 110 from the container's rim while it is being peeled because of the resistance provided by the support tab 110. In some embodiments, there are one or more film strips 104, 104' as a film strip 104 may be placed in any configuration on the lid 102 that will provide for the releasable detachment of the film strip 104 from the lid 102 without detaching or dislodging the support tab 110 from a container's rim or a wing 112 from the lid 102. For example, in some embodiments the lip contacting area 128' of the second wing 112' also includes a second film strip 104' as shown in FIGS. 1-3 with the broken lines, which form a part of the claimed invention. In some embodiments, the second film strip 104' is also removably attached to the second wing 112, wherein the second film strip 104' partially covers the lip contacting area 128' of the second wing 112', while in other embodiments, the second film strip 104' substantially and/or wholly covers the second lip contacting area 128' of the second wing 112'.

The film strip 104 includes a tab 162 that is constructed from the same material as the film strip 104. In some embodiments, the tab 162 does not include any adhesive but instead the tab 162 extends radially outward from the film strip 104 as shown in FIGS. 1-3, wherein the tab 162 is adapted to permit the removal of the film strip 104 from the lid 102 with ease. However, it is understood that the tab 162 may be positioned at different portions of the film strip 104, including but not limited to any area along the sides 164, 164' of the film strip 104 or along the bottom 166. In some embodiments, the film strip 104 includes a plurality of tabs 162, 162' wherein the tabs 162, 162' are spaced apart in random or uniform format along the perimeter 168 of the film strip 104.

Figure 6:
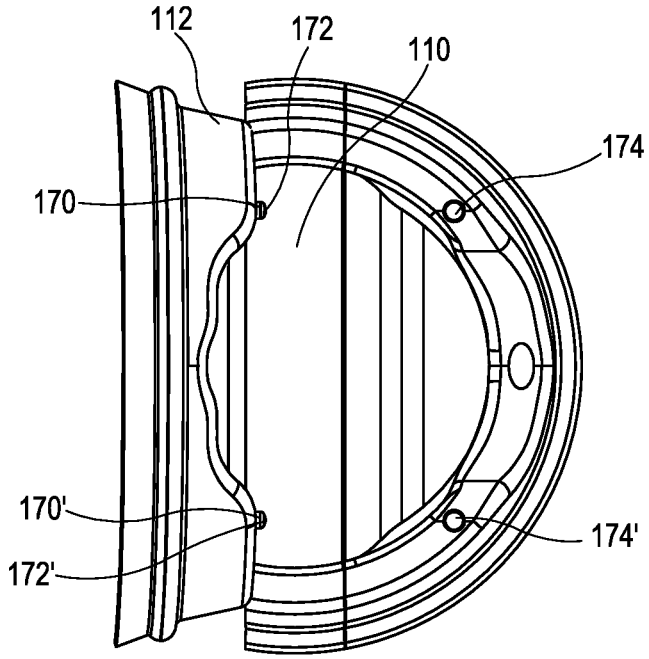
FIG. 6 is a top view with one wing of the lid open showing the snap extensions with the film strip removed.
Figure 7:
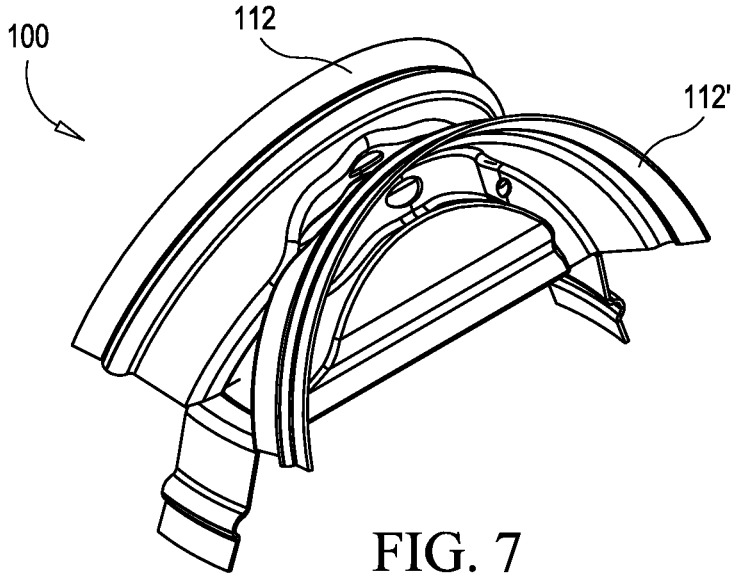
FIG. 7 shows both wings in the open position with the snap extensions fastened within the receptacles with the film strip removed.
Figure 8:
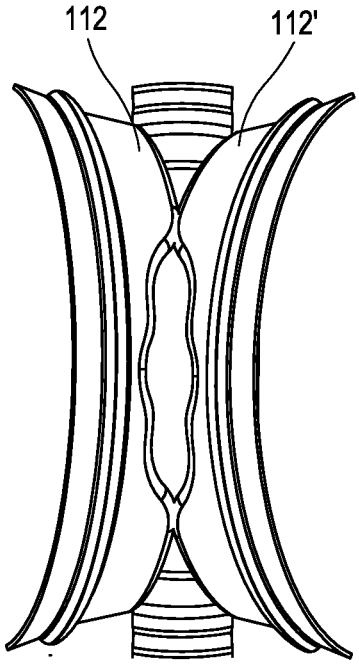
FIG. 8 is a perspective view with both wings in the open position with the snap extensions fastened within the receptacles with the film strip removed.

FIGS. 6-8 show the lid 102 with at least one wing 112 open with at least one snap extension 170 extending therefrom. As shown in FIGS. 6-9, the at least one or more snap extensions 170, 170' are positioned on the top rim 114 of the lid 102. However it is understood that the at least one or more snap extensions 170, 170' may be positioned on any one of the following: the at least one wing 112 or the second wing 112'. As shown, the at least one or more snap extensions 170, 170' are each adapted with an outwardly extending protrusion 172, 172' each adapted to fit within at least one receptacle 174 that is also positioned on the top rim 114. The at least one or more receptacles 174, 174' are apertures arranged diametrically opposite each snap extension 170 and they are adapted to sealingly engage the at least one or more snap extensions 170, 170' within. The at least one or more receptacles 174, 174' may be positioned on the top rim 114 of any one of the following: the at least one wing 112 or the second wing 112'.

As shown in FIGS. 7-8, both wings 112, 112' are open and extended upward whereby the at least one or more snap extensions 170, 170' are sealingly engaged by the at least one or more receptacles 174, 174' such that an individual may open the lid 102 from both sides for faster ventilation and cooling, where the wings 112, 112' remain open allowing at least one or more users to drink from the container through either opened wing 112, 112'.

Referring back to FIG. 1, the lid 102 further comprising of at least one annular opening 176 positioned on the lip contacting area 128, wherein the at least one annular opening 176 includes surrounding side walls 178 extending circumferentially therefrom and so dimensioned that when the lid 102 is seated on a container, it creates access to the inner section of the container. The annular opening 176 allows the user to access the contents of the container without having to remove the lid 102. The at least one annular opening 176 is preferably arranged in the middle of the u-shaped slope 124 of the lip contacting area 128, and in this manner when the individual's lips form a seal around the lid 102 there are no leaks. In some embodiments, the lid 102 may comprise of at least one or more annular openings 176, 176', as shown in FIGS. 1 & 2, such that the individual has a choice as to which annular opening 176 to drink therefrom. In such embodiment, the annular openings 176, 176' are diametrically opposite to each other on the at least one wing 112 or the second wing 112'.

While certain novel features of this invention have been shown and described and are pointed out in the annexed claims, it is not intended to be limited to the details above, since it will be understood that various omissions, modifications, substitutions and changes in the apparatus illustrated and in its operation can be made by those skilled in the art without departing in any way from the spirit of the present invention.

What is claimed is:

1. A lid comprising of:

(a) a brim latch that adjoins a rim, which extends around a periphery of the lid;

(b) a support tab in mating engagement with at least one wing that comprises of a top rim, an elevated member that extends upward and circumferentially from the brim latch, at least one sloped wall, and two side walls and wherein the at least one wing is perforatedly connected to the support tab extending from a distal end to a proximal end of the support tab's first horizontal edge; and (c) at least one film strip removably attached to the at least one wing, wherein the at least one film strip substantially covers the top rim of the at least one wing, which includes an arcuate portion sloping from side to side forming a downward u-shaped slope wherein the sides protrude upward and outward defining a lip contacting area causing a seal to be formed when the lip contacting area is engaged by an individual's lips.

2. The lid of claim 1, wherein the brim latch extends circumferentially along the lid's perimeter and includes a clamping edge that sealingly engages a rim of a container.

3. The lid of claim 1, wherein the at least onewing is releasably attached to a first horizontal edge of the support tabby perforations that extend from a distal end to a proximal end along the support tab's first horizontal edge.

4. The lid of claim 1, wherein the support tab is diametrically disposed across the lid extending from rim to rim and is adapted to provide an anchor for the at least one wing, when the at least one wing is in an open position.

5. The lid of claim 1, further comprising of a second wing of equal size arranged diametrically opposite the at least one wing.

6. The lid of claim 5, wherein the second wing is in mating engagement with the support tab.

7. The lid of claim 5, wherein the second wing is releasably attached along a second horizontal edge of the support tab by perforations that extend from a distal end to a proximal end of the support tab's second horizontal edge.

8. The lid of claim 5, wherein the second wing's top rim includes an arcuate portion sloping from side to side forming a u-shaped slope wherein the sides protrude upward and outward defining a lip contacting area causing a seal to be formed when the lip contacting area is engaged by an individual's lips.

9. The lid of claim 5, wherein the second wing includes a sloped wall oriented with a downward slant at an acute angle relative to the support tab.

10. The lid of claim 1, wherein the at least one sloped wall is oriented with a downward slant at an acute angle relative to the support tab.

11. The lid of claim 1, wherein an overflow well is formed between the support tab, the sloped wall and the lip contacting area that are bounded circumferentially by the elevated members.

12. The lid of claim 1, wherein the at least one film strip partially covers the at least one lip contacting area.

13. The lid of claim 1, a second film strip is removably attached to the second wing, wherein the second film strip partially covers the lip contacting area of the second wing.

14. The lid of claim 1, wherein the at least one film strip includes a tab extending radially outward from the film strip, wherein the tab is adapted to permit the removal of the film strip from the lid.

15. The lid of claim 1, further comprising of at least one snap extension positioned on the top rim of any one of the following: the at least one wing or the second wing.

16. The lid of claim 15, wherein the at least one snap extension is adapted with an outwardly extending protrusion.

17. The lid of claim 1, further comprising of a receptacle arranged diametrically opposite the at least one snap extension adapted to sealingly engage the at least one snap extension.

18. The lid of claim 17, wherein the receptacle may be positioned on the top rim of any one of the following: the at least one wing or the second wing.

19. The lid of claim 1, further comprising of at least one return vent positioned on any one of the following: the at least one wing or the second wing.

20. The lid of claim 1, wherein the film strip is layered with an adhesive.

21. The lid of claim 1, wherein the film strip is thermally applied to the lid.

22. The lid of claim 1, being constructed from any one or more of the following materials: plastic, light aluminum.

23. The lid of claim 1, further comprising of at least one annular opening.

24. The lid of claim 23, further comprising at least one annular opening positioned on the lip contacting area, wherein the at least one annular opening includes surrounding side walls extending circumferentially therefrom and so dimensioned that when the lid is seated on a container, it creates access to the inner section of the container.

* * * * *